US007248809B2

(12) United States Patent
Kim et al.

(10) Patent No.: US 7,248,809 B2
(45) Date of Patent: Jul. 24, 2007

(54) METHOD OF INDICATING A PAPER INSERTION DIRECTION AND A PRINTER DRIVER USING THE SAME

(75) Inventors: So-hye Kim, Suwon-si (KR); Eun-hui Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 258 days.

(21) Appl. No.: 10/989,634

(22) Filed: Nov. 17, 2004

(65) Prior Publication Data

US 2005/0105947 A1 May 19, 2005

(30) Foreign Application Priority Data

Nov. 17, 2003 (KR) ..... 10-2003-0081103
May 4, 2004 (KR) ..... 10-2004-0031327

(51) Int. Cl.
*G03G 15/00* (2006.01)

(52) U.S. Cl. ..... 399/81

(58) Field of Classification Search ..... 399/45, 399/81, 389, 393; 715/527; 358/1.12, 1.18
See application file for complete search history.

(56) References Cited

U.S. PATENT DOCUMENTS 4,586,034 A * 4/1986 Nakamine ..... 340/679
5,061,958 A * 10/1991 Bunker et al. ..... 399/81
5,301,036 A * 4/1994 Barrett et al. ..... 358/448
6,453,132 B2 * 9/2002 Ishikura ..... 399/81
6,618,061 B2 * 9/2003 Yamamoto ..... 715/817
6,697,091 B1 * 2/2004 Rzepkowski et al. ..... 715/835
6,785,488 B2 * 8/2004 Katsuyama ..... 399/84

(Continued)

FOREIGN PATENT DOCUMENTS

JP 04-169451 6/1992

(Continued)

OTHER PUBLICATIONS

Korean Official Action issued on Aug. 2, 2005, for Korean Patent Application No. 10-2003-0081103.

*Primary Examiner*—Robert Beatty
(74) *Attorney, Agent, or Firm*—Stanzione & Kim, LLP

(57) ABSTRACT

A method of indicating a paper insertion direction, the method including displaying an image of a paper cassette when a user tries to insert a paper on which other contents are previously printed into the paper cassette to print predetermined contents; displaying an expected print result indicating whether a to-be-printed side is on the same as a preprinted side of the paper and whether the to-be-printed side has the same up/down direction as the preprinted side; and displaying images that distinguish between front and rear sides of the paper and between up and down directions with respect to the preprinted side based on the expected print result. Also, a method of indicating a preprinted paper insertion direction and alarming improper insertion when inserting a preprinted paper into a printer, the method including displaying the preprinted paper insertion direction into a paper cassette on a display unit in the printer; determining whether the preprinted paper is properly inserted into the paper cassette; and outputting an alarm message if the preprinted paper is not properly inserted into the paper cassette.

35 Claims, 9 Drawing Sheets

U.S. PATENT DOCUMENTS 7,103,837 B2 * 9/2006 Sato ..... 715/527

FOREIGN PATENT DOCUMENTS

JP 05-064926 3/1993
JP 09146419 A * 6/1997
JP 10-217581 8/1998
JP 10222022 A * 8/1998
JP 2000211797 A * 8/2000
JP 2000-351260 12/2000
JP 2000351260 A * 12/2000
JP 2002226054 A * 8/2002
JP 2003101720 A * 4/2003
JP 2003271014 A * 9/2003

* cited by examiner

METHOD OF INDICATING A PAPER INSERTION DIRECTION AND A PRINTER DRIVER USING THE SAME

CROSS-REFERENCE TO RELATED APPLICATIONS

This application claims the priority of Korean Patent Application Nos. 2003-81103 and 2004-31327, filed on Nov. 17, 2003 and on May 4, 2004, respectively, in the Korean Intellectual Property Office, the disclosures of which are incorporated herein in their entirety and by reference.

BACKGROUND OF THE INVENTION

Field of the Invention

The present general inventive concept relates to a method of indicating a paper insertion direction and a printer driver using the same, and more particularly, a method of indicating a paper insertion direction, and enabling users to print using preprinted (i.e., used) paper by indicating a paper insertion direction. In addition, the present general inventive concept relates to a method of indicating a paper insertion direction into a paper cassette on a liquid crystal display (LCD) and outputting an alarm message in the event that the paper is not properly inserted.

Typically, it is preferable that used papers be reused to print unimportant contents. Printer users often have a difficult time trying to figure out how to insert used (i.e., preprinted) paper into a paper cassette so that the non-printed sides of the paper are used. To figure out a proper paper insertion direction, users may be required to perform a test print. This job is cumbersome and causes unnecessary paper consumption. In addition, a user may forget the proper paper insertion direction when the user later tries to print again by using the preprinted papers.

Additionally, users may try to print other contents on the preprinted sides of the papers. For example, a predetermined type of pattern or form may be previously printed on the preprinted side of the paper. In this case, the papers should be inserted into the printer paper cassette with the preprinted sides aligned in a proper up/down direction such that the other contents are printed on the preprinted sides of the papers. A test print should be performed to figure out a proper paper insertion direction, thus causing the consumption of papers.

In a conventional system, an icon has been marked on the floor of the paper cassette in order to indicate the paper insertion direction. When a user opens the paper cassette, a user may identify the icon on the floor of the paper cassette and insert a bundle of papers. However, if several papers remain in the paper cassette, a user must remove the remaining papers in order to identify the icon. This causes an inconvenience.

Furthermore, if a user is not familiar with the meaning of the icon, the papers may be inserted in an improper direction. The foregoing drawbacks of conventional systems lead to inconvenience and unnecessary consumption of printer supplies such as papers, inks, and toners.

SUMMARY OF THE INVENTION

The present general inventive concept provides a method of indicating a paper insertion direction into a paper cassette by displaying a to-be-printed side with respect to a preprinted side of a paper on which other contents are previously printed.

The present general inventive concept provides a printer driver that enables users to recognize a paper insertion direction into a paper cassette by displaying a to-be-printed side with respect to a preprinted side of a paper on which other contents are previously printed.

The present general inventive concept provides a method of indicating a paper insertion direction and alarming improper insertion by displaying the paper insertion direction on a liquid crystal display in a printer and outputting an alarm message in the event of improper insertion. The present general inventive concept thereby enables users to print using used or preprinted paper by properly inserting paper into the paper cassette.

Additional aspects and advantages of the present general inventive concept will be set forth in part in the description which follows and, in part, will be obvious from the description, or may be learned by practice of the general inventive concept.

The forgoing and/or other aspects and advantages of the present general inventive concept may be achieved by providing a method of indicating a paper insertion direction, the method comprising displaying an image of a paper cassette when a user tries to insert a paper on which other contents are previously printed into the paper cassette to print predetermined contents, displaying an expected print result indicating whether a to-be-printed side is the same as a preprinted side of the paper and whether the to be-printed side has the same up/down direction as the preprinted side, and displaying images that distinguish between front and rear sides of the paper and between up and down directions with respect to the preprinted side based on an expected print result.

The forgoing and/or other aspects and advantages of the present general inventive concept may also be achieved by providing a printer driver comprising a first unit to display a paper cassette when a user tries to insert a paper on which other contents are previously printed into the paper cassette to print predetermined contents, a second unit to display an expected print result indicating whether a to-be-printed side is the same as a preprinted side of the paper and whether the to-be-printed side has the same up/down direction as the preprinted side, and a third unit to display images that distinguish between front and rear sides of the paper and between up and down directions with respect to the preprinted side based on the expected print result.

The forgoing and/or other aspects and advantages of the present general inventive concept may also be achieved by providing a method of indicating a preprinted paper insertion direction and alarming when improperly inserting a preprinted paper into a printer, the method comprising displaying the preprinted paper insertion direction into a paper cassette on a display unit in the printer, determining whether the preprinted paper is properly inserted into the paper cassette, and outputting an alarm message if the preprinted paper is not properly inserted into the paper cassette.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
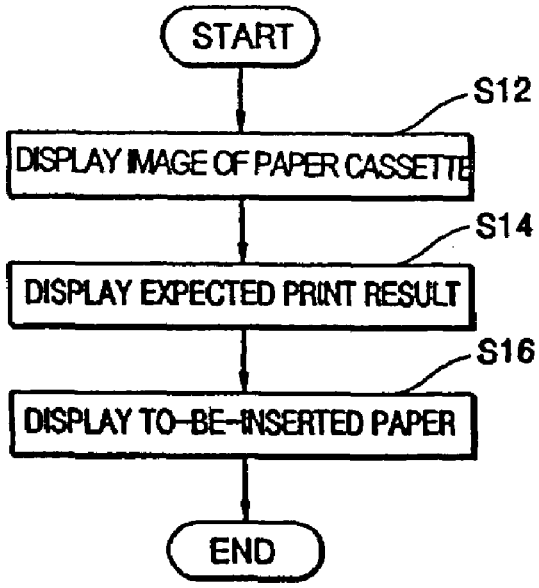
FIG. 1 shows a flow chart of a method of indicating a paper insertion direction according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 shows a flow chart of a method of indicating a paper insertion direction according to an embodiment of the present general inventive concept. First, a paper cassette is displayed (S12). An expected print result is displayed indicating whether the to-be-printed side is the same as the preprinted side and/or whether the to-be-printed side has the same up/down direction as the preprinted side (S14). Then, the up/down direction and the side of the paper to be inserted are displayed based on the expected print result (S16).

The paper cassette, the expected print result, and the to-be-inserted side of the paper may be displayed by a printer driver user interface on a computer monitor by using a dialog box.

While the paper cassette is displayed, the paper cassette opening direction can be also displayed. In addition, while the to-be-inserted side is displayed, the paper insertion direction can be also displayed.

Used paper may be reused to print other contents. A user may want to insert paper into the paper cassette such that contents are printed on the non-printed side of the used paper. According to the present general inventive concept, it is possible to readily recognize the paper insertion direction when re-using paper to print predetermined contents on the non-printed side of the used paper.

The preprinted paper may include paper having a certain type of pattern or form which has been previously printed. A user may want to insert the previously printed paper into the paper cassette such that contents are printed on the same side of the preprinted paper having the certain type of pattern or form thereon. According to the present general inventive concept, it is possible to readily recognize the paper insertion direction such that predetermined contents may be printed on the side of the paper on which the pattern or form is preprinted.

The printed paper may also include a paper that distinguishes between front and rear sides and between up and down directions. In addition, a paper having a necessary print direction and/or a paper having a marking that distinguishes between front and rear sides and between up and down directions may be used to print. According to the present general inventive concept, it is possible to readily recognize the paper insertion direction to print in a desired direction and on a desired side of the paper.

Figure 2:
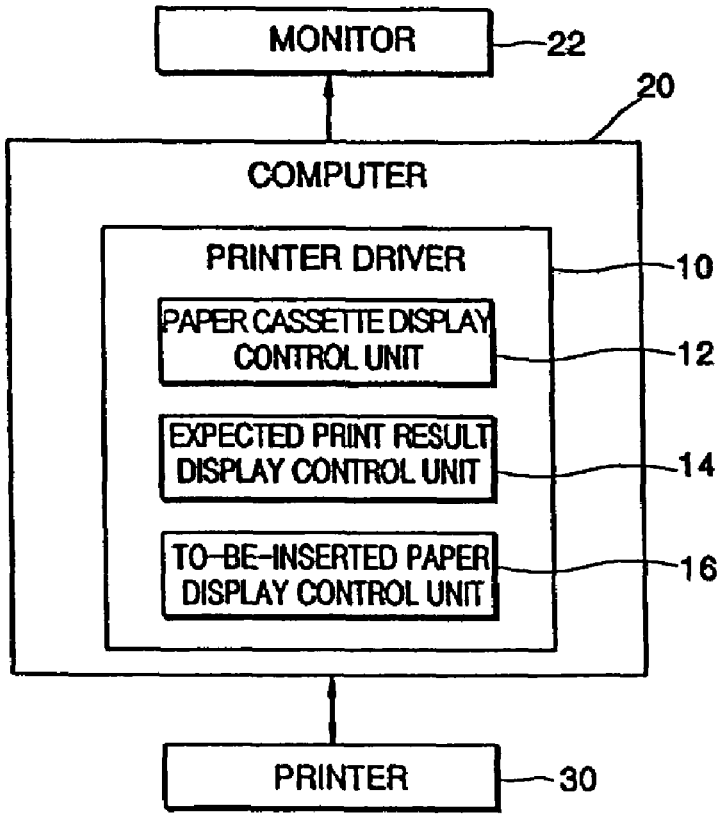
FIG. 2 shows a block diagram of a printer driver according to an embodiment of the present general inventive concept.

FIG. 2 shows a block diagram of a printer driver according to an embodiment of the present general inventive concept. The printer driver 10 may be implemented in software, hardware, or a combination thereof. A printer driver 10 according to the present embodiment is installed in a computer 20. The computer 20 is connected to a monitor 22 and a printer 30. The printer driver 10 according to the present embodiment displays the paper insertion direction that enables users to recognize the to-be-printed side on which predetermined contents are to be printed with respect to the preprinted side on which other contents have been previously printed. Accordingly, the preprinted papers are properly inserted into the printer paper cassette to print predetermined contents thereon from the printer 30 that is connected to the computer 20.

The printer driver 10 comprises a paper cassette display control unit 12 that displays the paper cassette, an expected print result display control unit 14 that displays the expected print result indicating whether the to-be-printed side is the same as the preprinted side and/or whether the to-be-printed side's up/down direction is the same as the preprinted side, and a to-be-inserted paper display control unit 16 that displays front and rear sides and up and down directions of the paper to be inserted into the paper cassette with respect to the preprinted side based on the expected print result.

The paper cassette display control unit 12, the expected print result display control unit 14, and the to-be-inserted paper display control unit 16 control the display of the paper cassette, the display of the expected print result, and the display of the to-be-inserted paper on the monitor 22 by using a dialog box as a user interface of the printer driver 10.

The paper cassette display control unit 12 may control the display of a paper cassette opening direction. In addition, the to-be-inserted paper display control unit 16 may control the display of a direction of inserting the to-be-inserted paper into the paper cassette.

The preprinted paper may include used paper, paper having a predetermined type of pattern, and paper which is designed to distinguish between front and rear sides and between up and down directions. In addition, other special types of paper may also be used with the present general inventive concept.

Figure 3A:
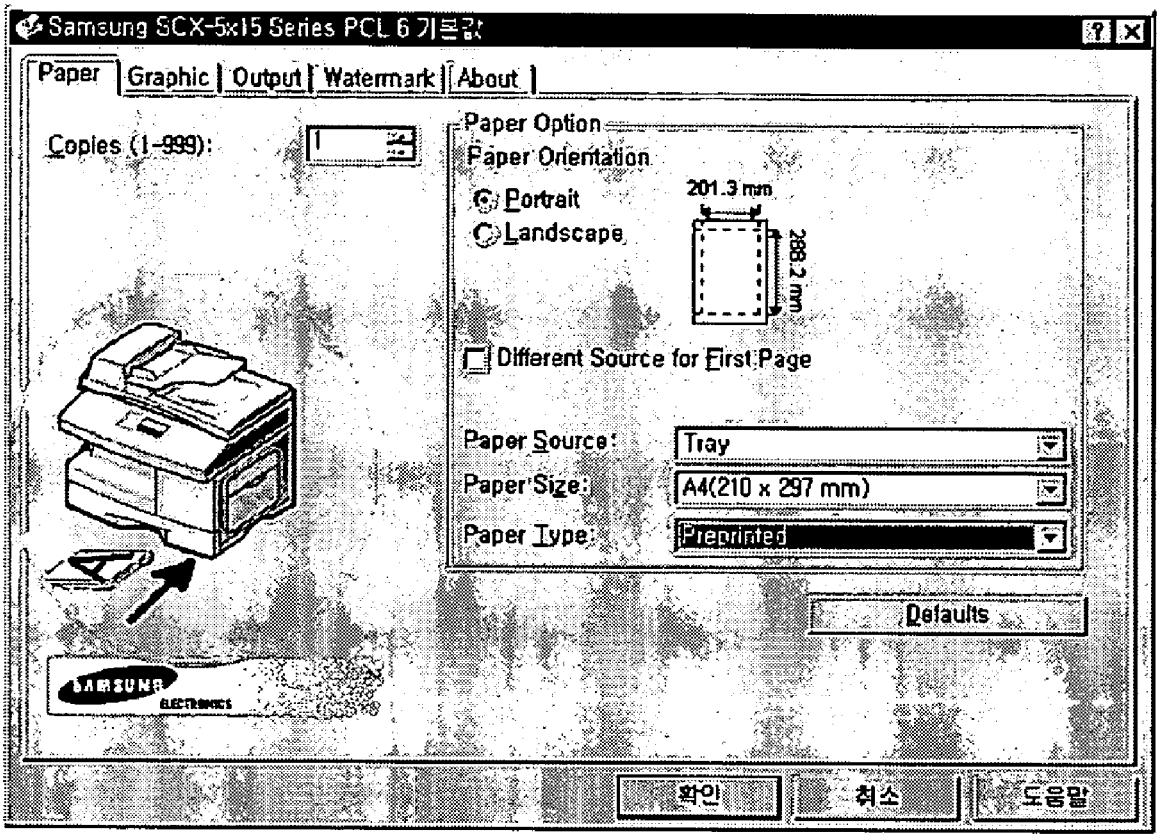
FIGS. 3A and 3B show examples of a user interface indicating a paper insertion direction.
Figure 3B:
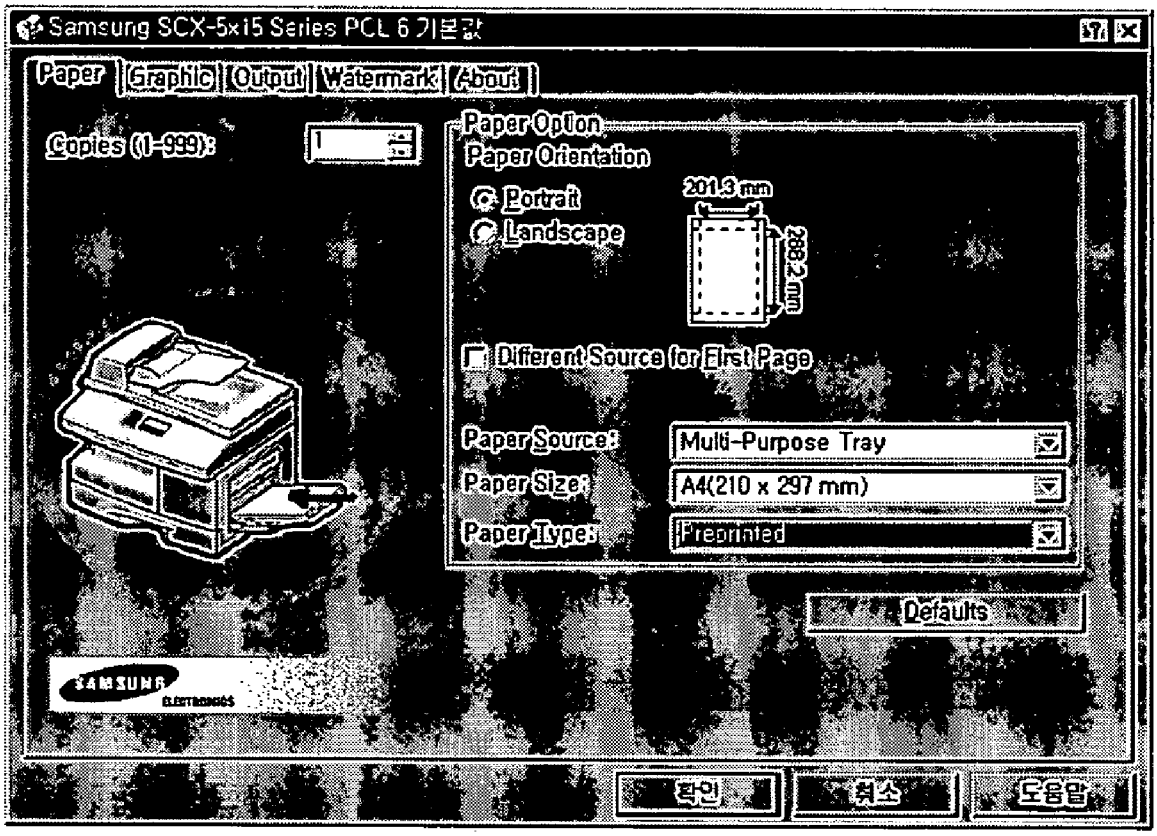

FIGS. 3A and 3B show examples of a user interface indicating a paper insertion direction.

If a user selects "Preprinted" as a paper type in the user interface of the printer driver, a paper insertion direction is displayed. In other words, if a paper cassette or a paper source is set to "Tray 1," for example, a direction of inserting papers into tray 1 of the printer paper cassette may be displayed on the user interface. Similarly, if the paper source is set to "Multi-Purpose Tray," a direction of inserting papers into the multi-purpose tray may be displayed on the user interface.

Figure 4:
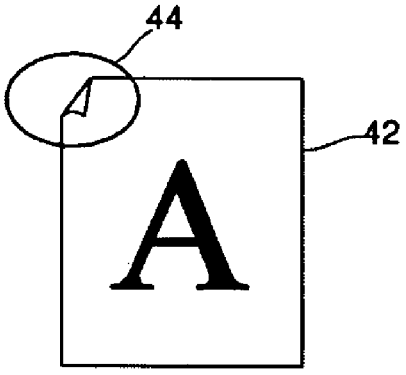
FIG. 4 shows a preprinted paper.

FIG. 4 shows a preprinted paper. The letter "A" is shown on the preprinted side 42 of the preprinted paper and a marking 44 indicates an upper left edge of the preprinted side. Front and rear sides and up and down directions will be used to describe the paper inserted into the paper cassette using the marking 44 with reference to FIGS. 5A through 8B.

Various embodiments shown in FIGS. 5A through 8B can be displayed on the dialog box as a user interface by the printer driver. The letter "A" is illustrated as a solid line on the preprinted side and as a dotted line on the to-be-printed side. Therefore, if a user wants to print on the preprinted side, the letter "A" shown as the solid line and the letter "A" shown as the dotted line will be displayed on the same side.

Figure 5A:
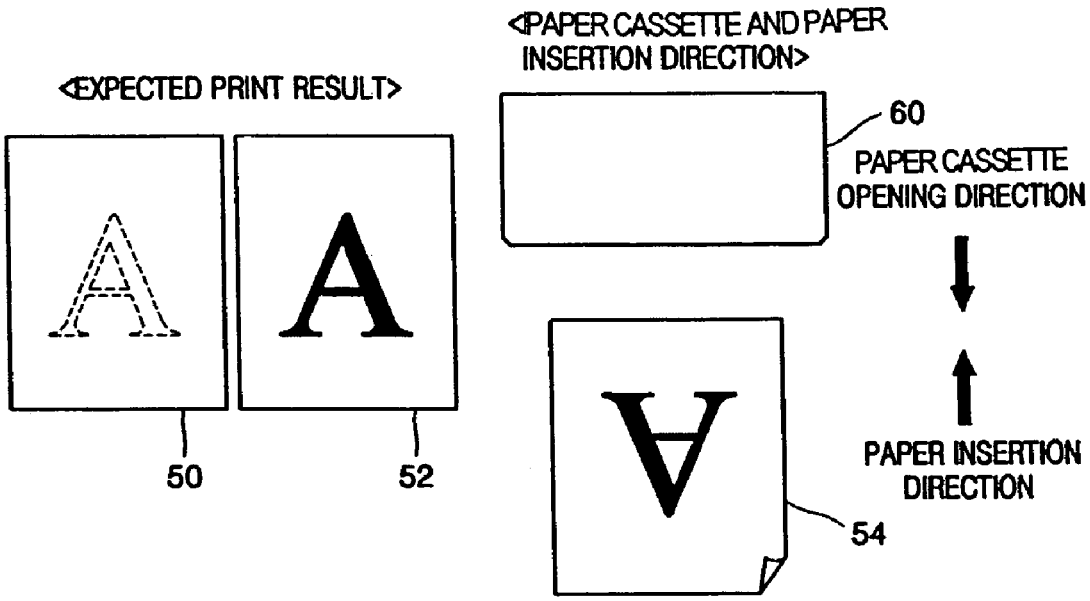
FIGS. 5A and 5B show images displayed in a dialog box that indicate a paper insertion direction according to an embodiment of the present general inventive concept.
Figure 5B:
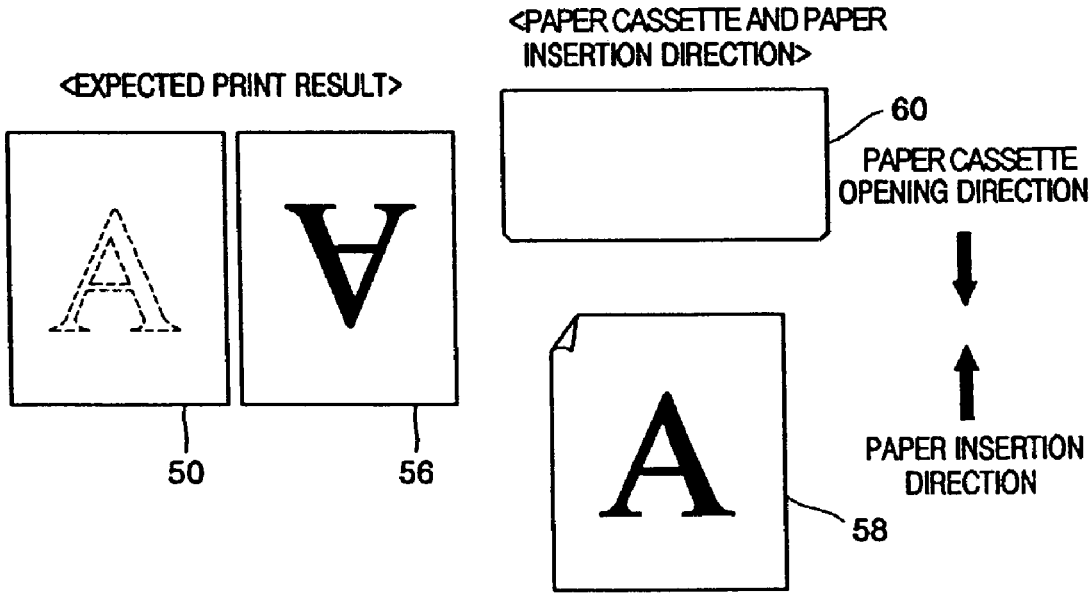

FIGS. 5A and 5B show images displayed in a dialog box that indicate a paper insertion direction according to an embodiment of the present general inventive concept. FIGS. 5A and 5B show paper insertion directions when contents are printed on the opposite side of the preprinted side. For exemplary purposes, when referring to FIGS. 5A and 5B, it may be assumed that the paper source is set to "Tray 1," and the paper type is set to "Preprinted."

In the example illustrated in FIG. 5A, the expected print result shows that the to-be-printed side 50 is opposite to the preprinted side 52 and their up/down directions are the same. In this case, the paper 54 is inserted into the paper cassette 60 in a reversed direction with the preprinted side facing upward. In other words, in order to obtain the print result shown in the left side of the FIG. 5A, the paper is inserted into the paper cassette as shown in the right side. In addition, a paper cassette opening direction is illustrated near the paper cassette 60, and the paper insertion direction is illustrated near the to-be-inserted paper 54.

In the example illustrated in FIG. 5B, the expected print result shows that the to-be-printed side 50 is opposite to the preprinted side 52 and their up/down directions are different from each other. In this case, the paper 54 is inserted into the paper cassette 60 in a forward direction with the preprinted side facing upward.

Figure 6A:
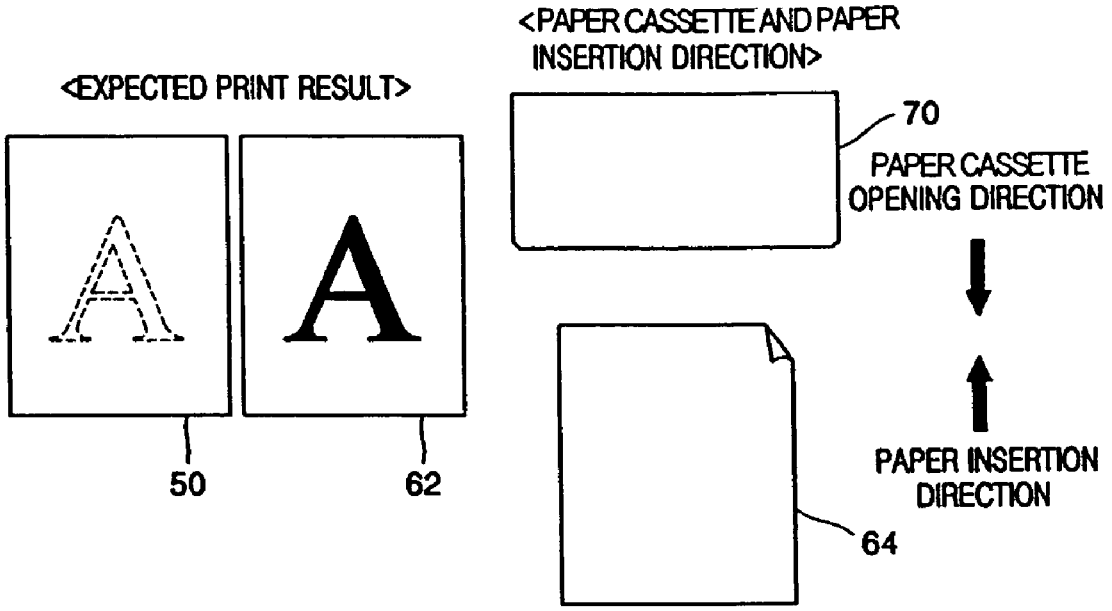
FIGS. 6A and 6B show images displayed in a dialog box that indicate a paper insertion direction according to another embodiment of the present general inventive concept.
Figure 6B:
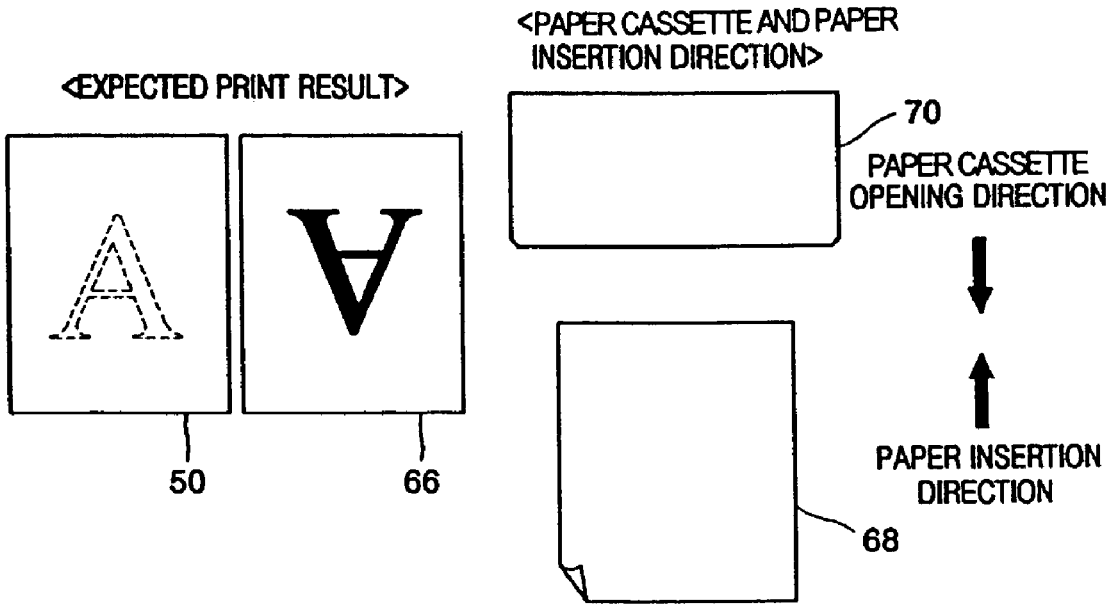

FIGS. 6A and 6B show images displayed in a dialog box that indicate a paper insertion direction according to another embodiment of the present general inventive concept. FIGS. 6A and 6B show paper insertion directions when contents are printed on the opposite side of the preprinted side. For exemplary purposes, when referring to FIGS. 6A and 6B, it may be assumed that the paper source is set to "Tray 2," and the paper type is set to "Preprinted." Herein, the "Tray 2" may be a multi-purpose tray.

In the example illustrated in FIG. 6A, the expected print result, shows that the to-be-printed side 50 is opposite to the preprinted side 62 and their up/down directions are the same. In this case, the paper 64 is inserted into the paper cassette 70 in a forward direction with the preprinted side facing downward. In other words, in order to obtain the print result shown in the left side of the FIG. 6A, the paper is inserted into the paper cassette as illustrated in the right side.

In the example illustrated in FIG. 6B, the expected print result shows that the to-be-printed side 50 is opposite to the preprinted side 66 and their up/down directions are different from each other. In this case, the paper 68 is inserted into the paper cassette 70 in a reverse direction with the preprinted side facing downward.

As described above, in order to print on the non-printed side of the preprinted paper, it is possible to use the methods illustrated in FIGS. 5A through 6B. Typically, when used papers are reused, up/down directions of the to-be-printed side and the preprinted side are not necessarily considered. Therefore, the methods illustrated in FIGS. 5A through 6B can be used.

Figure 7A:
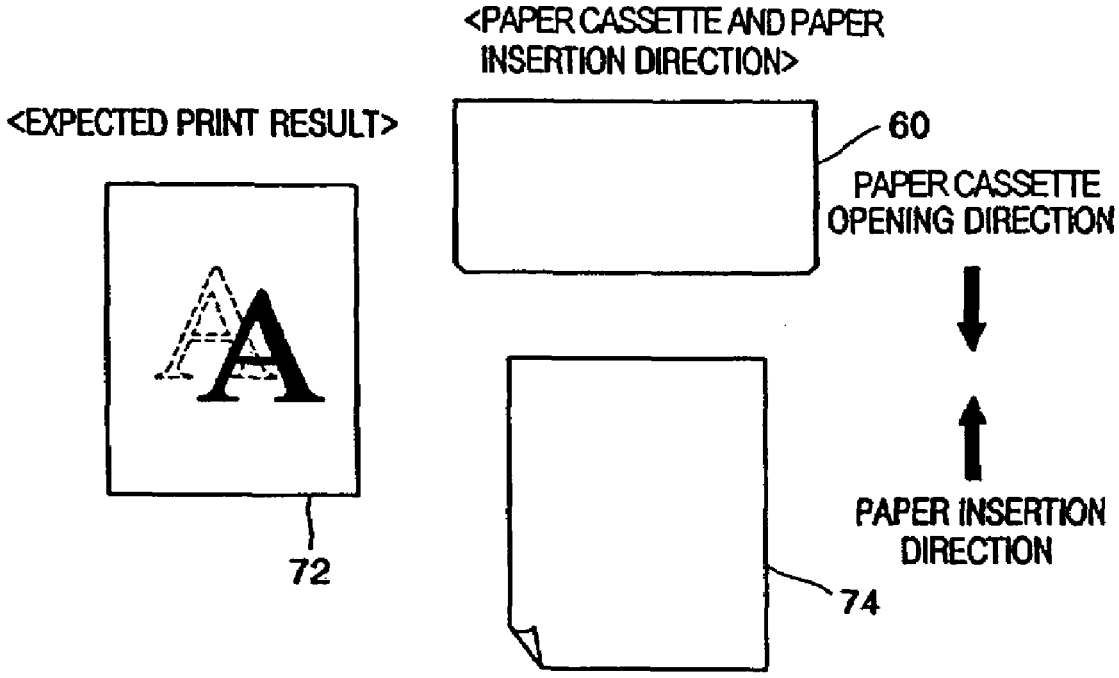
FIGS. 7A and 7B show images displayed in a dialog box that indicate a paper insertion direction according to another embodiment of the present general inventive concept.
Figure 7B:
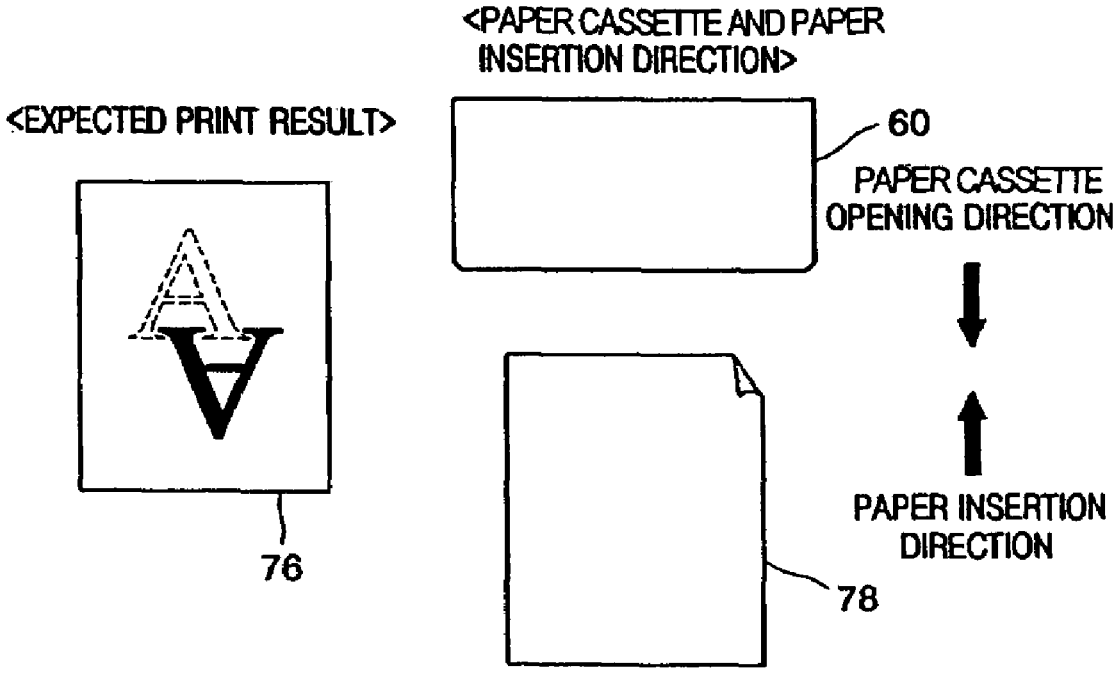

FIGS. 7A and 7B show images displayed in a dialog box that indicate a paper insertion direction according to another embodiment of the present general inventive concept. FIGS. 7A and 7B show paper insertion directions when contents are printed on the preprinted side. For exemplary purposes, when referring to FIGS. 7A and 7B, it may be assumed that the paper source is set to "Tray 1," and the paper type is set to "Preprinted."

In the example illustrated in FIG. 7A, the expected print result shows that the to-be-printed side 72 is the same as the preprinted side 72, and their up/down directions are the same. In this case, the paper 74 is inserted into the paper cassette 60 in a reversed direction with the preprinted side facing downward. In other words, in order to obtain the print result shown in the left side of the FIG. 7A, the paper is inserted into the paper cassette as illustrated in the right side.

In the example illustrated in FIG. 7B, the expected print result shows that the to-be-printed side 76 is the same as the preprinted side 76 and their up/down directions are different from each other. In this example, the paper 78 is inserted into the paper cassette 60 in a forward direction with the preprinted side facing downward.

Figure 8A:
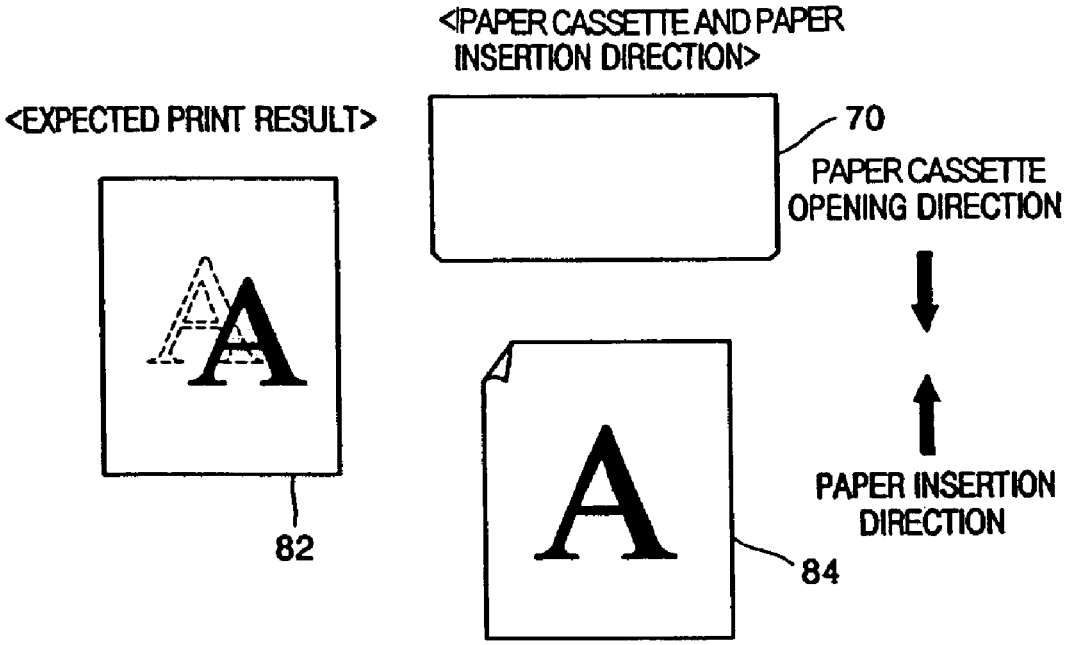
FIGS. 8A and 8B show images displayed in a dialog box that indicate a paper insertion direction according to another embodiment of the present general inventive concept.
Figure 8B:
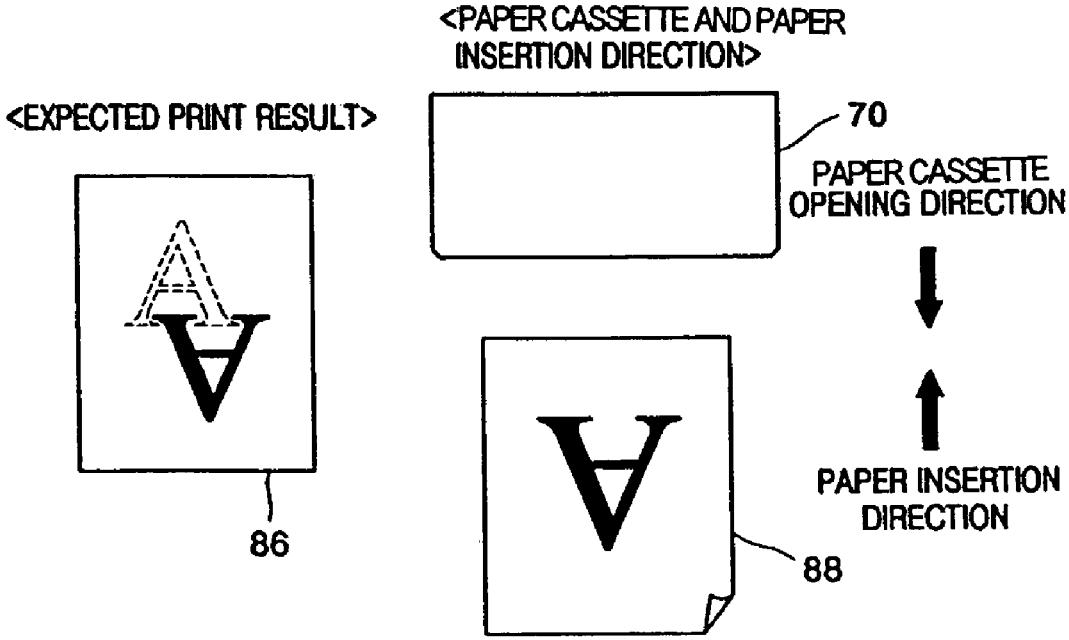

FIGS. 8A and 8B show images displayed in a dialog box that indicate a paper insertion direction according to another embodiment of the present general inventive concept. FIGS. 8A and 8B show paper insertion directions when contents are printed on the preprinted side. For exemplary purposes, when referring to FIGS. 8A and 8B, it may be assumed that the paper source is set to "Tray 2," and the paper type is set to "Preprinted."

In the example illustrated in FIG. 8A, the expected print result, shows that the to-be-printed side 82 is the same as the preprinted side 82, and their up/down directions are the same. In this case, the paper 84 is inserted into the paper cassette 70 in a forward direction with the preprinted side facing upward. In other words, in order to obtain the print result shown in the left side of the FIG. 8A, the paper is inserted into the paper cassette as illustrated in the right side.

In the example illustrated in FIG. 8B, the expected print result shows that the to-be-printed side 86 is the same as the preprinted side 86 and their up/down directions are different from each other. In this case, the paper 88 is inserted into the paper cassette 70 in a reverse direction with the preprinted side facing upward.

When printing is performed on a paper having a predetermined type of pattern or form, the methods shown in FIGS. 7A and 8A may be used to print new contents on the preprinted side having the same up/down direction as the preprinted contents.

As described above, a method of indicating a paper insertion direction according to the present general inventive concept can be implemented on a dialog box used as a user interface of the printer driver. In addition, a method of indicating a paper insertion direction according to the present general inventive concept can be implemented on a help tab of the printer driver.

Figure 9:
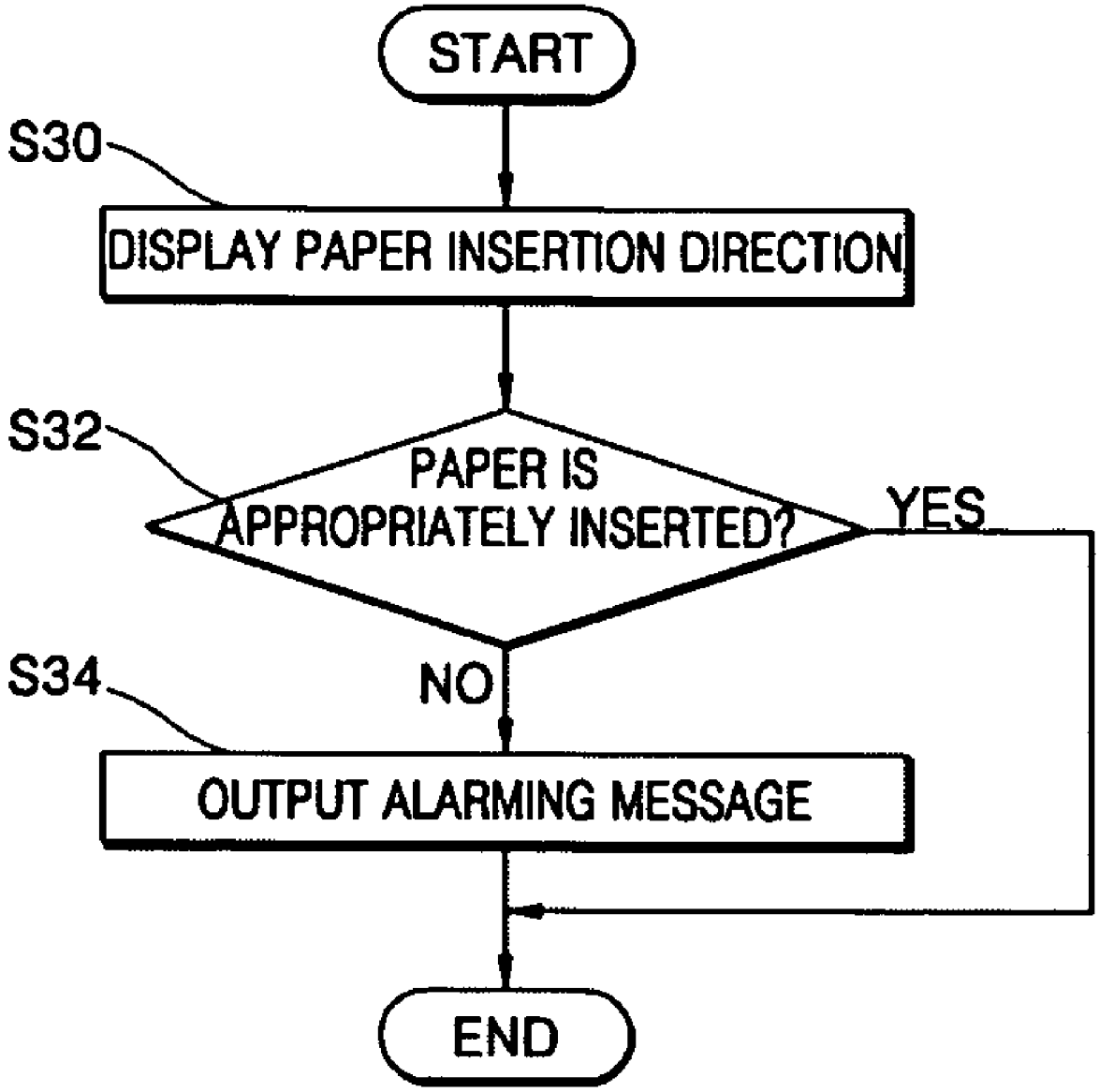
FIG. 9 shows a flow chart of a method of indicating a paper insertion direction and alarming according to the present general inventive concept.

FIG. 9 shows a flow chart of a method of indicating a paper insertion direction and alarming according to an embodiment of the present general inventive concept. FIG. 9 shows a method of inserting a preprinted paper into the printer paper cassette such that printing is performed on a non-printed side of the preprinted paper. A direction of inserting the paper into the paper cassette is displayed on a display unit in the printer (S30). Then, the method determines whether the paper is properly inserted into the paper cassette (S32). An alarm message is output when the paper is not properly inserted (S34).

Figure 10:
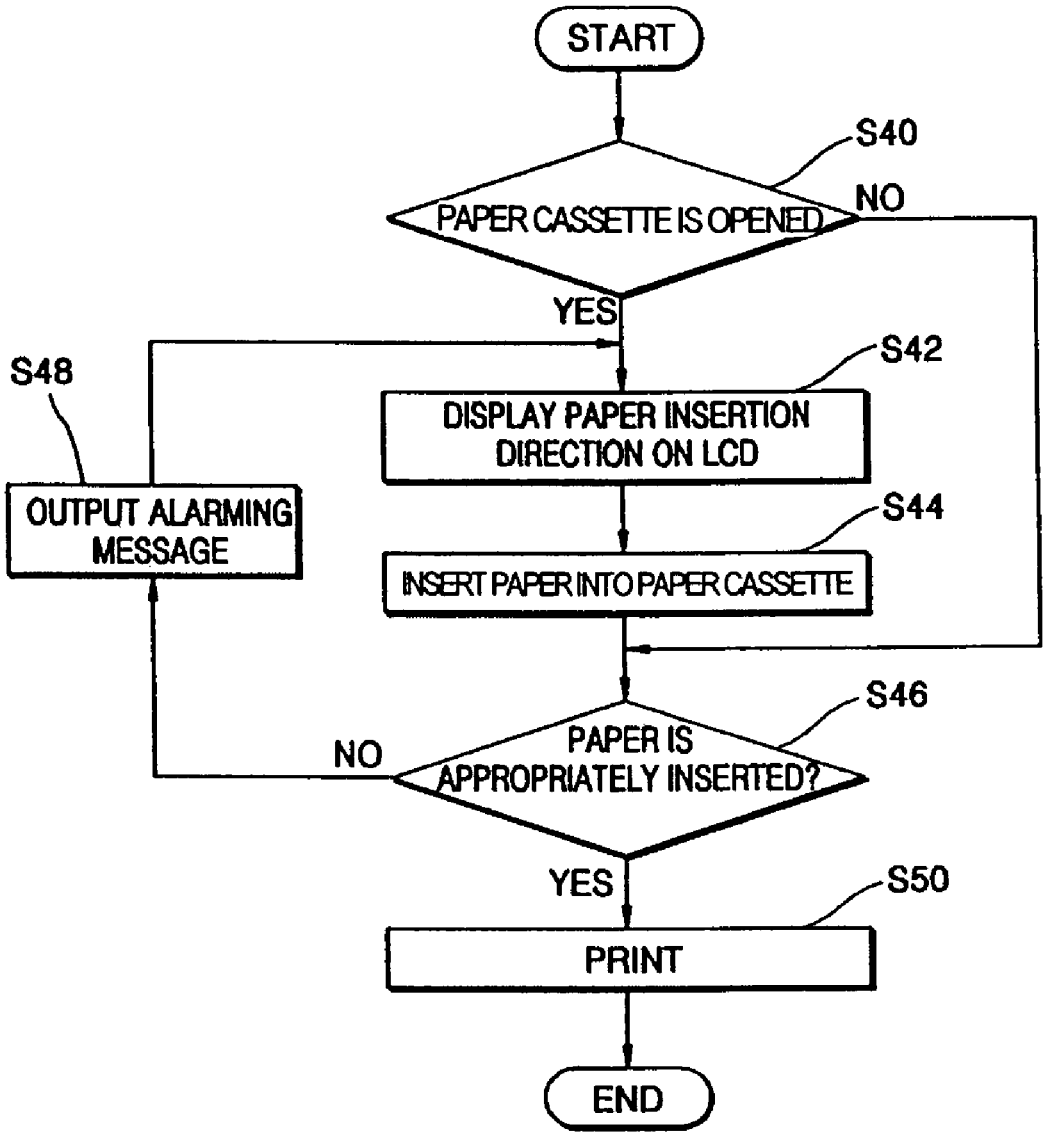
FIG. 10 shows a flow chart that describes FIG. 9 in more detail.

FIG. 10 shows a flow chart that describes the method of FIG. 9 in more detail. A method of indicating a paper insertion direction and alarming according to the present embodiment will be described in more detail with reference to FIG. 10.

First, the method determines whether the paper cassette is open (S40). If the paper cassette is closed, operation S46 is carried out. If the paper cassette is open, the paper insertion direction is displayed on a display unit, for example, a liquid crystal display (LCD) (S42). Then, the paper is inserted into the paper cassette by a user.

Next, the method determines whether the preprinted paper is properly inserted (S46) such that printing is performed on the non-printed side of the paper. This can be accomplished by determining whether the surface of the paper is blank by detecting reflectance of the surface of the paper by using one or more infrared sensors. One or more infrared sensors may be installed in proper positions in the paper cassette to detect whether the surface of the paper that is laid on the paper cassette is the preprinted surface. Alternatively, the infrared sensors may be installed in a paper feeding line, so that the infrared sensors detect whether the surface of the paper is the preprinted surface during the time that the paper is fed through a roller for printing. Other types of sensors may be used to detect the surface of the preprinted paper.

If it is determined at operation (S46) that the paper is properly inserted, a normal printing is accomplished (S50). However, if it is determined at operation (S46) that the paper is not properly inserted, an alarming message is output (S48). For example, the alarm message can be displayed on an LCD. An alarm sound may also be used in conjunction with, or instead of, an alarm message.

The method described with reference to FIG. 10 may alternatively be used to achieve other print results. For example, (S46) may determine whether paper is properly inserted such that printing is performed on the preprinted side of the paper rather than the non-printed side of the paper.

Accordingly, the paper insertion directions displayed in a dialog box as a user interface of the printer driver have been described with reference to FIGS. 5A through 8B. However, it should be appreciated by those skilled in the art that the examples shown in FIGS. 5A through 8B can be displayed on a display unit of a printer, for example, an LCD according to various embodiments of the present general inventive concept. Therefore, detailed description for examples of the paper insertion directions displayed on the LCD of a printer will not be repeated.

According to the various embodiments of the present general inventive concept, it is possible to readily recognize a paper insertion direction into a printer paper cassette such that printing is accomplished on the non-printed side of a preprinted paper.

In addition, it is possible to readily recognize a paper insertion direction into a printer paper cassette even when printing on other kinds of paper such as paper having a pattern thereon, paper of which a printing direction must be considered, and paper having a marking that distinguishes between front and rear sides and between up and down directions of the paper.

Accordingly, it is possible to reduce consumption of paper, toner and ink, because it is not necessary for a user to perform a test print in order to identify the paper insertion direction, because the paper insertion direction is displayed before printing.

Furthermore, it is possible to readily recognize the paper insertion direction by displaying the print direction on an LCD display of a printer.

Also, it is possible to prevent print errors by outputting an alarm message when the paper is not properly inserted.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of indicating a paper insertion direction, the method comprising:

displaying an image of a paper cassette when a user tries to insert a paper on which other contents are previously printed into the paper cassette to print predetermined contents;

displaying an expected print result indicating whether a to-be-printed side is the same as a preprinted side of the paper and whether the to-be-printed side has the same up/down direction as the preprinted side; and displaying images that distinguish between front and rear sides of the paper and between up and down directions with respect to the preprinted side based on the expected print result.

2. The method according to claim 1, wherein displaying an image of a paper cassette further comprises displaying a paper cassette opening direction.

3. The method according to claim 1, wherein displaying images that distinguish between front and rear sides of the paper and between up and down directions further comprises displaying a paper insertion direction into the paper cassette.

4. A printer driver comprising:

a first means for displaying a paper cassette when a user tries to insert a paper on which other contents are previously printed into the paper cassette to print predetermined contents;

a second means for displaying an expected print result indicating whether a to-be-printed side is the same as a preprinted side of the paper and whether the to-be-printed side has the same up/down direction as the preprinted side; and a third means for displaying images that distinguish between front and rear sides of the paper and between up and down directions with respect to the preprinted side based on the expected print result.

5. The printer driver according to claim 4, wherein the first means includes a means for displaying a paper cassette opening direction.

6. The printer driver according to claim 4, wherein the third means includes a means for displaying a paper insertion direction into the paper cassette.

7. The printer driver according to claim 4, wherein the first means, the second means, and the third means display an image of the paper cassette, the expected print result, and the images that distinguish between front and rear sides of the paper and between up and down directions on a computer monitor by using a dialog box as a user interface of the printer driver.

8. The printer driver according to claim 4, wherein the paper on which other contents are previously printed includes used paper.

9. The printer driver according to claim 4, wherein the paper on which other contents are previously printed includes paper having a predetermined pattern.

10. The printer driver according to claim 4, wherein the paper on which other contents are previously printed includes paper having a marking that distinguishes between front and rear sides and between up and down directions.

11. A method of indicating a preprinted paper insertion direction and alarming improper insertion when inserting a preprinted paper into a printer, the method comprising:

displaying the preprinted paper insertion direction into a paper cassette on a display unit in the printer;

determining whether the preprinted paper is properly inserted into the paper cassette; and outputting an alarm message if the preprinted paper is not properly inserted into the paper cassette.

12. The method according to claim 11, wherein determining whether the preprinted paper is properly inserted includes detecting reflectance of the preprinted paper by using at least one infrared sensor.

13. The method according to claim 11, wherein the display unit includes a liquid crystal display (LCD) installed in the printer.

14. The method according to claim 11, wherein outputting an alarm message further comprises:

displaying an alarm message on the display unit; and outputting an alarm sound.

15. A method of indicating a paper insertion direction to print predetermined contents on paper having a preprinted side and a non-printed side, the method comprising:

displaying a paper insertion direction; and displaying an expected print result that corresponds to the paper insertion direction indicating whether the predetermined contents are to be printed on the same side as the preprinted side of the paper.

16. The method of claim 15, wherein the paper insertion direction and the expected print result depend on one or more of:

a user-selected type of paper; and a user-selected paper cassette.

17. The method of claim 15, wherein displaying the paper insertion direction further comprises:

displaying a paper cassette with the paper insertion direction in response to one or more of a user attempting to print on the used paper, a user selecting a type of used paper to print the predetermined contents on, and a user selecting a paper source from which to print.

18. The method of claim 15, wherein the expected print result includes an image of the preprinted side and a to-be-printed side.

19. The method of claim 15, further comprising:

displaying one or more images that indicate whether the preprinted side and the to-be-printed side have the same front/rear directions, and whether the preprinted side and the to-be-printed side have the same up/down directions.

20. The method of claim 15, further comprising:

enabling a user to print the predetermined contents on the non-printed side.

21. The method of claim 15, further comprising:

enabling a user to print the predetermined contents on the preprinted side.

22. The method of claim 15, further comprising:

receiving a paper type selection, wherein the selected paper type is one of a used paper type, a pattern paper type, and a paper having a marking that distinguishes between up/down and front/rear directions.

23. A method of indicating a paper insertion direction into a paper cassette to print predetermined contents on paper having a preprinted side and a non-printed side, the method comprising:

determining if the paper cassette is open;

if the paper cassette is open, displaying a paper insertion direction; and if the paper cassette is not open, determining whether the paper is properly inserted in the paper cassette, and if the paper is not properly inserted in the paper cassette, outputting an alarm message.

24. The method of claim 23, wherein displaying the paper insertion direction further comprises displaying the paper insertion direction on one of a printer LCD display and a printer driver dialog box.

25. The method of claim 23, wherein determining whether the paper is properly inserted further comprises one or more of:

detecting a reflectance of the paper in the paper cassette to determine whether the predetermined contents are to be printed on the non-printed side; and detecting a reflectance of the paper as the paper is fed through a printer roller to determine whether the predetermined contents are to be printed on the non-printed side.

26. The method of claim 25, wherein detecting the reflectance of the paper in the paper cassette further comprises using at least one sensor to detect the reflectance of the paper in the paper cassette.

27. The method of claim 23, wherein outputting an alarm message further comprises outputting an alarm message if the predetermined contents are not to be printed on the non-printed side of the paper.

28. A printer driver that indicates a paper insertion direction to print predetermined contents on used paper having a preprinted side and a non-printed side comprising:

a paper insertion direction display unit to display a paper insertion direction; and an expected print result display unit to display an expected print result that corresponds to the paper insertion direction indicating whether the predetermined contents are to be printed on the same side as the preprinted side of the paper.

29. The method of claim 15, wherein the displaying of the paper insertion direction comprises:

displaying the paper insertion direction with respect to a paper cassette.

30. The method of claim 15, further comprising:

displaying an orientation of the preprinted side of the paper.

31. The printer driver of claim 30, wherein the paper insertion direction display unit displays the paper insertion direction with respect to a paper cassette.

32. The printer driver of claim 30, wherein the expected print result display unit displays an orientation of the preprinted side of the paper.

33. A method of indicating a paper insertion direction to print predetermined contents on print medium having a preprinted side and a non-printed side, the method comprising:

displaying an orientation of the preprinted side of the print medium;

displaying an orientation of an expected print result based on whether the predetermined contents are to be printed on the same side as the preprinted side of the paper; and displaying a paper insertion direction based on the orientation of the preprinted side of the print medium and the orientation of the expected print result.

34. A printer driver to indicate a paper insertion direction to print predetermined contents on a print medium having a preprinted side and a non-printed side, comprising:

a display unit to display a paper insertion direction and an expected print result that corresponds to the paper insertion direction indicating whether the predetermined contents are to be printed on the same side as the preprinted side of the paper; and a sensor to distinguish the preprinted side from the non-printed side of the print medium.

35. A printer driver, comprising:

a first display unit to displaying a paper cassette when a user tries to insert a paper on which other contents are previously printed into the paper cassette to print predetermined contents;

a second display unit to display an expected print result indicating whether a to-be-printed side is the same as a preprinted side of the paper and whether the to-be-printed side has the same up/down direction as the preprinted side; and a third display unit to display images that distinguish between front and rear sides of the paper and between up and down directions with respect to the preprinted side based on the expected print result.

* * * * *